US010013827B2

(12) United States Patent
Asano et al.

(10) Patent No.: US 10,013,827 B2
(45) Date of Patent: Jul. 3, 2018

(54) CONTROL DEVICE AND CONTROL SYSTEM FOR VEHICLE OPENING/CLOSING BODY

(71) Applicants: AISIN SEIKI KABUSHIKI KAISHA, Kariya-shi, Aichi-ken (JP); TOYOTA JIDOSHA KABUSHIKI KAISHA, Toyota-shi, Aichi-ken (JP)

(72) Inventors: Ryo Asano, Owariasahi (JP); Takeshi Nishikibe, Tokai (JP); Yoshinori Hitomi, Okazaki (JP); Takeshi Katsuda, Nagoya (JP)

(73) Assignees: AISIN SEIKI KABUSHIKI KAISHA, Kariya-Shi, Aichi-Ken (JP); TOYOTA JIDOSHA KABUSHIKI KAISHA, Toyota-Shi, Aichi-Ken (JP)

( * ) Notice: Subject to any disclaimer, the term of this patent is extended or adjusted under 35 U.S.C. 154(b) by 0 days.

(21) Appl. No.: 14/975,178

(22) Filed: Dec. 18, 2015

(65) Prior Publication Data

US 2016/0180616 A1 Jun. 23, 2016

(30) Foreign Application Priority Data

Dec. 18, 2014 (JP) ..... 2014-255704

(51) Int. Cl.
*G07C 9/00* (2006.01)
*E05F 15/611* (2015.01)
(Continued)

(52) U.S. Cl.
CPC ..... *G07C 9/00126* (2013.01); *E05F 15/611* (2015.01); *E05F 15/73* (2015.01);
(Continued)

(58) Field of Classification Search
CPC .. G07C 9/00007; G07C 9/00126; E05F 15/73
(Continued)

(56) References Cited

U.S. PATENT DOCUMENTS 7,868,735 B2 1/2011 Nakashima et al.
2003/0137195 A1* 7/2003 Suzuki ..... B60R 25/04 307/10.6
(Continued)

FOREIGN PATENT DOCUMENTS

EP 2787157 A1 10/2014
JP 8-199882 A 8/1996
(Continued)

OTHER PUBLICATIONS

Notification of reasons for Refusal dated Apr. 21, 2017, by the Japanese Patent Office, in corresponding Japanese Patent Application No. 2014-255704 with English-language translation (8 pages).
(Continued)

*Primary Examiner* — Vernal Brown
(74) *Attorney, Agent, or Firm* — Buchanan Ingersoll & Rooney PC

(57) ABSTRACT

A control device for a vehicle opening/closing body includes an electronic control unit configured to determine whether a prescribed specific operation is performed by a user on a closing switch that is provided in an opening/closing body of a vehicle to cause the opening/closing body to perform a closing operation, the electronic control unit being configured to cause the opening/closing body to perform the closing operation, and to lock the vehicle when the electronic control unit determines that the specific operation is performed.

4 Claims, 7 Drawing Sheets

(51) Int. Cl.
*E05F 15/73* (2015.01)
*E05F 15/77* (2015.01)

(52) U.S. Cl.
CPC ..... *E05F 15/77* (2015.01); *E05Y 2400/40* (2013.01); *E05Y 2400/45* (2013.01); *E05Y 2900/531* (2013.01); *E05Y 2900/546* (2013.01)

(58) Field of Classification Search
USPC ..... 340/5.7
See application file for complete search history.

(56) References Cited

U.S. PATENT DOCUMENTS

| | | | | |
|---|---|---|---|---|
| 2006/0066147 | A1* | 3/2006 | Ohta | E05F 15/70 307/10.1 |
| 2006/0214769 | A1 | 9/2006 | Nakashima et al. | |
| 2007/0115096 | A1* | 5/2007 | Suzuki | B60R 25/2036 340/5.72 |
| 2014/0361810 | A1* | 12/2014 | Sasabe | H04L 25/0274 326/63 |
| 2015/0218869 | A1 | 8/2015 | Yamagiwa et al. | |

FOREIGN PATENT DOCUMENTS

| | | | |
|---|---|---|---|
| JP | 2006233675 | A | 9/2006 |
| JP | 2006-266023 | A | 10/2006 |
| JP | 2006347292 | A | 12/2006 |
| JP | 4434084 | B2 | 1/2010 |
| JP | 2011-214341 | A | 10/2011 |
| JP | 2011-256675 | A | 12/2011 |
| JP | 2013-28903 | A | 2/2013 |
| JP | 5327520 | B2 | 10/2013 |
| JP | 5423988 | B2 | 2/2014 |
| JP | 2014-125750 | A | 7/2014 |
| JP | 2015-148093 | A | 8/2015 |

OTHER PUBLICATIONS

Office Action (Notification of Reasons for Refusal) dated Nov. 30, 2017, by the Japanese Patent Office in corresponding Japanese Patent Application No. 2014-255704, and an English Translation of the Office Action. (7 pages).

Japanese Official Action dated Oct. 4, 2016, by the Japanese Patent Office, in corresponding Japanese Patent Application No. 2014-255704 with English-language translation (8 pages).

* cited by examiner

CONTROL DEVICE AND CONTROL SYSTEM FOR VEHICLE OPENING/CLOSING BODY

INCORPORATION BY REFERENCE

The disclosure of Japanese Patent Application No. 2014-255704 filed on Dec. 18, 2014 including the specification, drawings and abstract is incorporated herein by reference in its entirety.

BACKGROUND OF THE INVENTION

1. Field of the Invention

The present invention relates to a control technology in which a vehicle opening/closing body is electrically caused to perform a closing operation and locking is performed in accordance with an operation performed on a closing switch that causes the vehicle opening/closing body to perform the closing operation.

2. Description of Related Art

There has been conventionally known a technology in which opening/closing and locking/unlocking of an electric door of a vehicle are performed with the use of a portable (mobile device) carried by a user. Japanese Patent Application Publication No. 2011-214341 (JP 2011-214341 A) describes a technology in which when a user operates an operation switch of a portable, an electric door is fully closed; when the user operates a locking switch of the portable, locking of the electric door is reserved under a prescribed condition; and when the electric door is closed, locking is performed.

In the technology described in JP 2011-214341 A, it is necessary for the user to take out the portable to reserve locking of a door (a vehicle opening/closing body) of a vehicle, and further, it is necessary to separately perform, on the portable, an operation for a closing operation of the vehicle opening/closing body and an operation for locking of a vehicle. These actions and operations for locking the vehicle become troublesome for the user.

SUMMARY OF THE INVENTION

The present invention provides a control device for a vehicle opening/closing body to improve convenience for a user in a closing operation of the vehicle opening/closing body and locking of a vehicle.

An aspect of the present invention relates to a control device for a vehicle opening/closing body. The control device includes an electronic control unit configured to determine whether a prescribed specific operation is performed by a user on a closing switch that is provided in an opening/closing body of a vehicle to cause the opening/closing body to perform a closing operation, the electronic control unit being configured to cause the opening/closing body to perform the closing operation, and to lock the vehicle when the electronic control unit determines that the specific operation is performed.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
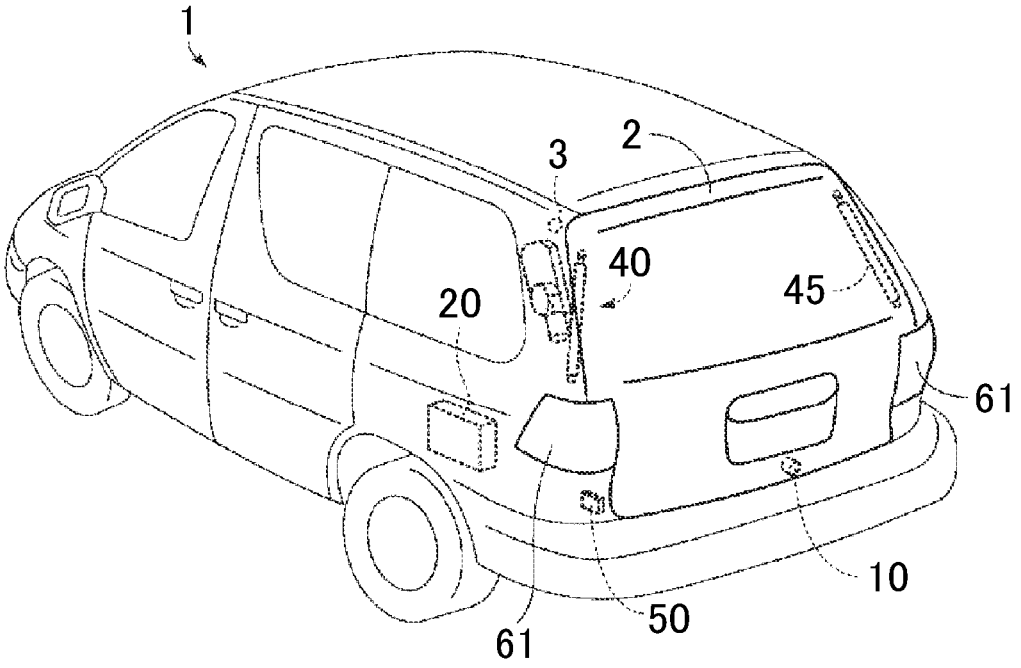
FIG. 1 is a schematic configuration diagram of a vehicle including a control device for a vehicle opening/closing body according to a first embodiment.

FIG. 1 is a schematic configuration diagram of a vehicle 1 including a control device 20 for a vehicle opening/closing body according to a first embodiment of the present invention.

The vehicle 1 is provided with a plurality of doors (opening/closing bodies), and a rear part of the vehicle 1 is provided with a power back door (hereinafter referred to as an "opening/closing body 2"), a drive unit 40 configured to drive the opening/closing body 2 to open/close the opening/closing body 2, a courtesy switch 50 configured to detect an open/closed state of the opening/closing body 2, and a tail lamp 61 as a light generator. In the present embodiment, a power back door is regarded as the opening/closing body 2, but the present invention is also applicable to a slide door for a rear seat and a swing door for each of a driver seat and a passenger seat.

Figure 2:
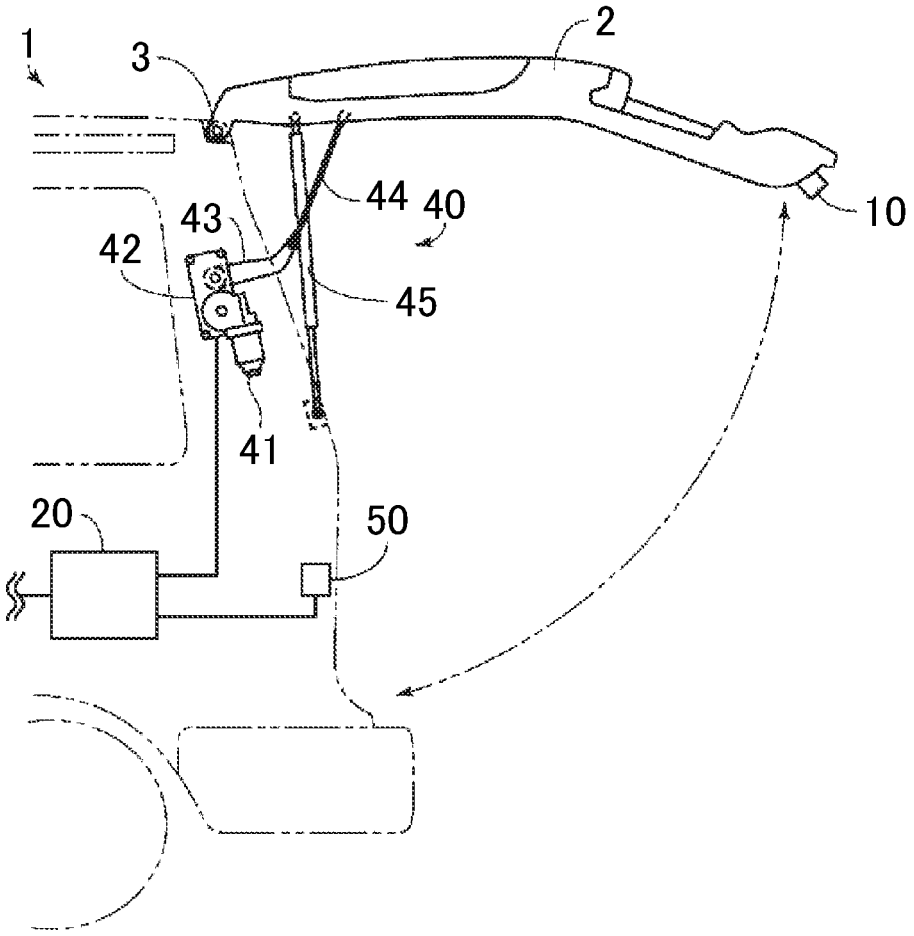
FIG. 2 is a schematic configuration diagram of a drive unit according to the first embodiment.

The opening/closing body 2 is attached to a vehicle body of the vehicle 1 via a hinge 3 such that the opening/closing body 2 can be opened and closed. An end portion of the opening/closing body 2 in an opened state is provided with a closing switch 10 configured to electrically cause the opening/closing body 2 to perform a closing operation (i.e., a closing switch 10 configured to electrically close the opening/closing body 2). As illustrated in FIG. 2, the closing switch 10 may be placed at a position that allows a user to easily operate the closing switch 10 even when the opening/closing body 2 is completely opened (in a fully opened state), although the position of the closing switch 10 is not limited to this position.

When the user operates (performs an operation on) the closing switch 10, the closing switch 10 sends a signal indicative of the operation to the control device 20. Upon receipt of the signal, the control device 20 controls the drive unit 40 to electrically cause the opening/closing body 2 to perform the closing operation 8 (i.e., the control device 20 controls the drive unit 40 to cause the opening/closing body 2 to perform the electrical closing operation 8, that is, the control device 20 controls the drive unit 40 to electrically close the opening/closing body 2). Further, when the user operates the closing switch 10 during the electrical closing operation of the opening/closing body 2, the control device 20 controls the drive unit 40 to stop the electrical closing operation of the opening/closing body 2. In the present embodiment, the closing switch 10 is a button-type switch, and when the user presses the closing switch 10, the control device 20 determines that the closing switch 10 is operated.

The vehicle 1 is provided with a sound generator 60 (see FIG. 6), so as to generate a sound such as a melody or a buzzer to provide an indication to the user. The tail lamp 61 as a light generator performs hazard lighting to provide an indication to the user. As for a content of the indication, as will be described later, types of the sound or a lighting pattern is changed depending on whether a normal operation is performed or a specific operation is performed on the closing switch 10, so that the user is informed that locking (lock) of the vehicle 1 is also performed as well as the closing operation of the opening/closing body 2. The "sound generator 60" and the "tail lamp 61 as a light generator" correspond to "an alarm."

FIG. 2 is a schematic configuration diagram of the drive unit 40 for the opening/closing body 2. The drive unit 40 includes a motor 41, a deceleration mechanism 42, an operation arm 43, an operation rod 44, and a gas damper 45.

The control device 20 controls a relay (not shown) to control application, interruption, and direction of a current flowing through the motor 41, thereby controlling rotation of the motor 41. The rotation of the motor 41 is decelerated by the deceleration mechanism 42, and then moves the operation arm 43 so as to cause the opening/closing body 2 to perform an opening/closing operation, via the operation rod 44 configured such that one end thereof is rotatably connected to the operation arm 43 and the other end thereof is rotatably connected to the opening/closing body 2. One end of the gas damper 45 is attached to a vehicle body of the vehicle 1 and the other end thereof is attached to the opening/closing body 2, and thus, the gas damper 45 urges the opening/closing body 2 in an open direction using a gas reaction force.

Figure 3:
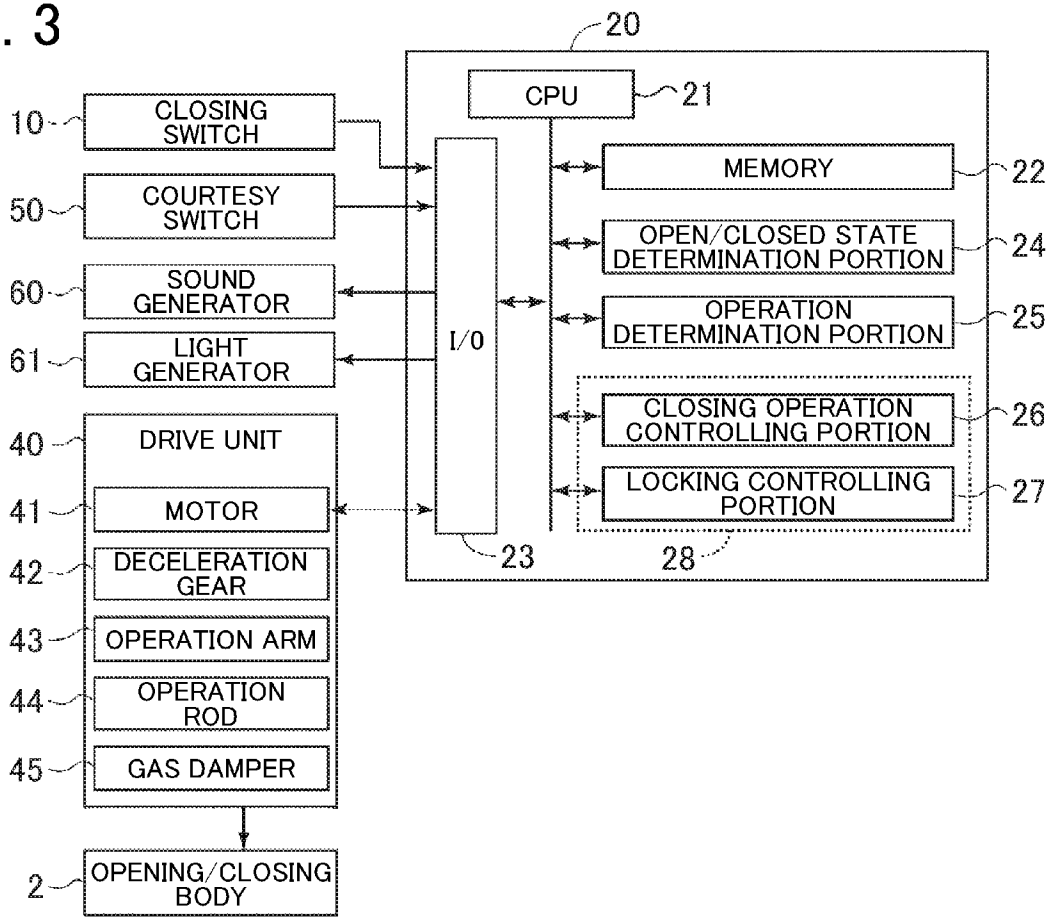
FIG. 3 is a block diagram of a control device and the like according to the first embodiment.

FIG. 3 is a block diagram of the control device 20, and the like. As illustrated in FIG. 3, the control device 20 is an ECU (Electronic Control Unit) including a CPU 21, a memory 22, and an input-output circuit (I/O) 23, which are connected via buses, and is connected, via the input-output circuit 23, to the closing switch 10, the drive unit 40, the courtesy switch 50, the sound generator 60, and the light generator 61. The memory 22 has functions of an ROM that stores various control programs and an RAM that temporarily stores various data. Further, a power-supply voltage is supplied to the control device 20 from a battery of the vehicle 1 via a power supply circuit (not shown).

Further, the control device 20 includes an open/closed state determination portion 24, an operation determination portion 25, a closing operation controlling portion 26, and a locking controlling portion 27, as functional portions realized (implemented) by the CPU 21 in accordance with a prescribed program stored in the memory 22.

The open/closed state determination portion 24 determines whether the opening/closing body 2 is in an open state or in a closed state, based on information from the courtesy switch 50. Note that the open state includes not only a fully open state, but also an incompletely open state. The operation determination portion 25 determines, based on a signal from the closing switch 10, whether a normal operation or a prescribed specific operation is performed on the closing switch 10 by the user.

Here, the "normal operation" indicates an operation in which the user presses the closing switch 10 once so as to close the opening/closing body 2. Further, the "specific operation" indicates a second operation in which the user presses the closing switch 10 within a prescribed time after a first operation of pressing the closing switch 10 is performed, so as to close the opening/closing body 2 and to lock the vehicle 1. For example, the specific operation is an operation in which the user presses the closing switch 10 twice consecutively. As for the prescribed time, a value stored in advance in the memory 22 may be read by the CPU 21, or may be changed afterward in view of the convenience of the user. The prescribed time is not limited, but is a time equal to or less than one second and may be 0.8 seconds, for example.

The closing operation controlling portion 26 controls the drive unit 40 in response to an operation on the closing switch 10, so as to cause the opening/closing body 2 to perform a closing operation. The locking controlling portion 27 locks the vehicle 1 based on a determination result that the specific operation is performed on the closing switch 10, the determination result being obtained by the operation determination portion 25. Note that the locking of the vehicle 1 is not limited to locking of all opening/closing bodies of the vehicle 1, but also includes a case where only one or some of the opening/closing bodies (e.g., the opening/closing body 2) is/are locked. Further, when the closing operation controlling portion 26 and the locking controlling portion 27 are collectively referred to as a "controlling portion 28," the controlling portion 28 is a functional portion that performs both functions of the closing operation controlling portion 26 and the locking controlling portion 27.

Figure 4:
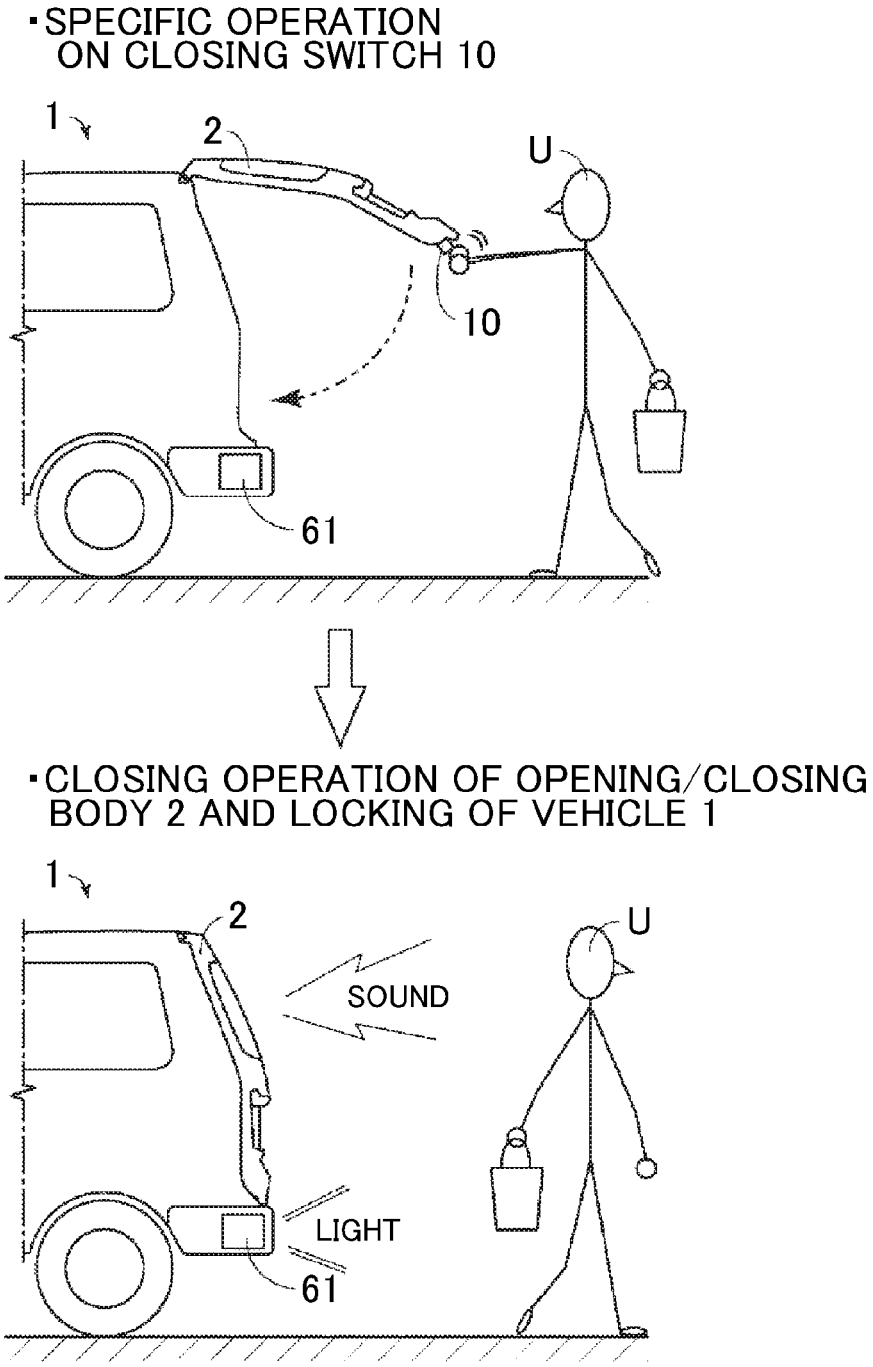
FIG. 4 is a conception diagram illustrating a closing operation of the opening/closing body and locking of a vehicle.

FIG. 4 is a conception diagram illustrating a state where the opening/closing body 2 is automatically closed and the vehicle 1 is locked in response to the specific operation on the closing switch 10 performed by the user. As illustrated in FIG. 4, in order to close the opening/closing body 2 and to lock the vehicle 1, a user U performs a first operation on the closing switch 10 and then performs a second operation on the closing switch 10 within a prescribed time. Thus, the opening/closing body 2 automatically performs a closing operation (i.e., the opening/closing body 2 is automatically closed), and the vehicle 1 is locked. The user U can be informed of completion of the locking of the vehicle 1 by a melody sound and hazard lighting from the sound generator 60 and the light generator 61.

Figure 5:
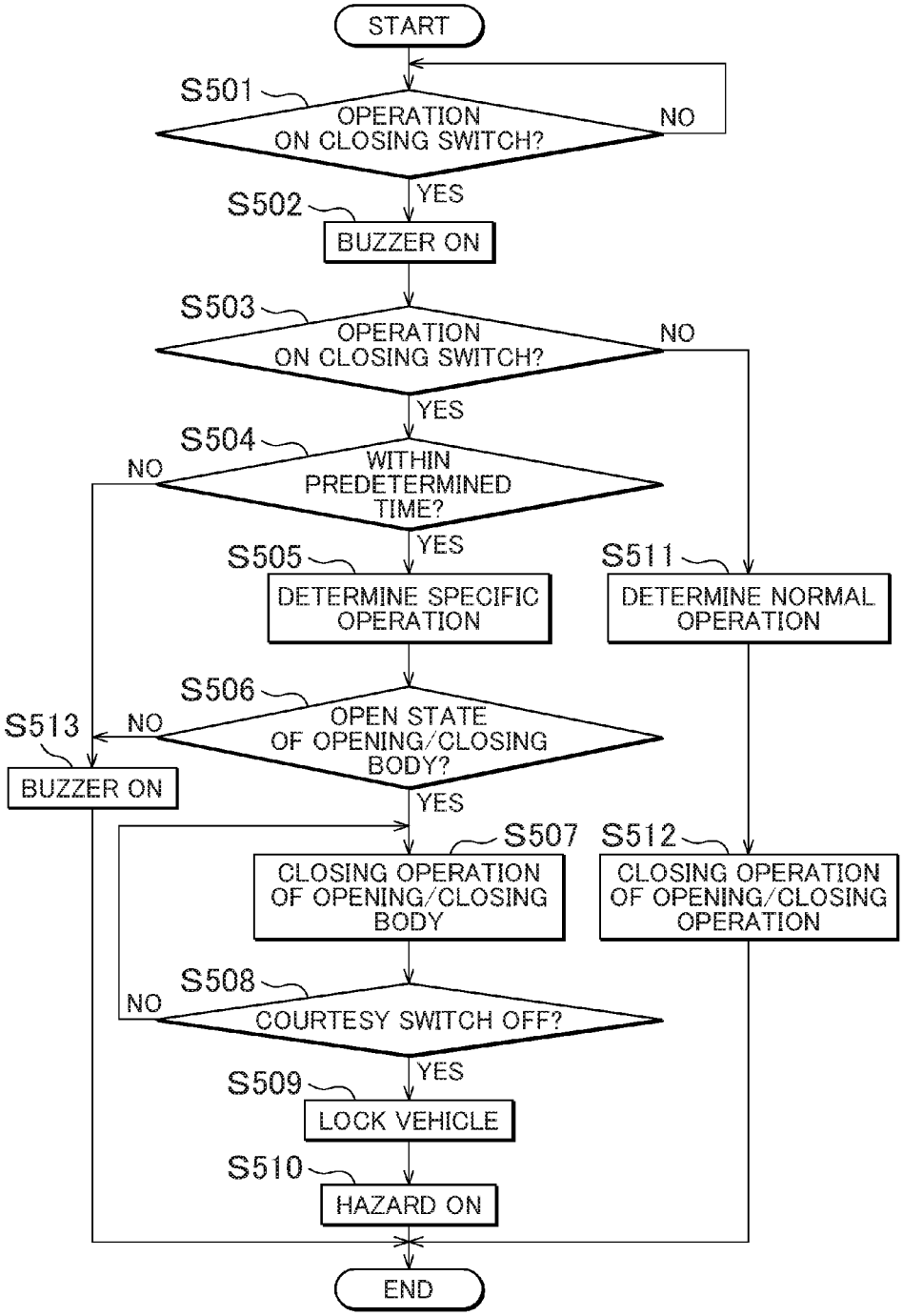
FIG. 5 is a flowchart for the closing operation of the opening/closing body and the locking of the vehicle according to the first embodiment.

FIG. 5 is a flowchart of a process for a closing operation of the opening/closing body 2 and locking of the vehicle 1, the process being performed by the control device 20.

In S501, the operation determination portion 25 determines whether a signal indicative of an operation on the closing switch 10 is received, that is, whether the first operation is performed on the closing switch 10. When it is determined that the first operation is performed, the process proceeds to S502. In S502, the control device 20 controls the sound generator 60, and in response to that, the sound generator 60 generates a buzzer so as to inform the user that the operation on the closing switch 10 is received.

In S503, the operation determination portion 25 determines whether a signal indicating that the closing switch 10 has been operated is further received from the closing switch 10, that is, whether the second operation is performed on the closing switch 10. When it is determined that the second operation is performed, the process proceeds to S504, and otherwise, the process proceeds to S511. Note that the buzzer generated in S502 may be stopped.

In S504, the operation determination portion 25 determines whether the second operation in S503 is performed within a prescribed time after it is determined that the first operation is performed in S501. When it is determined that the second operation is performed within the prescribed time, the process proceeds to S505, and otherwise, the process proceeds to S513. In S505, the operation determination portion 25 determines that the specific operation is performed on the closing switch 10 by the user.

In S506, the open/closed state determination portion 24 determines whether the opening/closing body 2 is in an open state, based on information from the courtesy switch 50 or another ECU (not shown). When it is determined that the opening/closing body 2 is in an open state, the process proceeds to S507, and otherwise, the process proceeds to S513. Note that, as long as the control device 20 can detect that the opening/closing body 2 is in an open state, the control device 20 may be configured to use information from the other ECU (for example, a body ECU) without including the open/closed state determination portion 24, instead of being configured to include the open/closed state determination portion 24 that determines the open state by itself.

In S507, the closing operation controlling portion 26 controls the drive unit 40 to cause the opening/closing body 2 to perform a closing operation. At this time, the control device 20 controls the sound generator 60 to generate a melody sound indicating that reservation of the closing operation of the opening/closing body 2 and locking of the vehicle 1 has been received, so as to inform the user that the reservation has been received. Thus, the user can leave the vehicle 1 before the opening/closing body 2 is closed and the vehicle 1 is locked, and thus, the convenience for the user is improved.

In S508, the open/closed state determination portion 24 determines whether an OFF signal is received from the courtesy switch 50, that is, whether a signal indicating that the opening/closing body 2 enters a closed state is received. When the signal is received, the process proceeds to S509, and otherwise, the process of S507 (the closing operation of the opening/closing body 2) is continued.

In S509, in response to the determination that the opening/closing body 2 enters a closed state, the determination being made by the open/closed state determination portion 24, the closing operation controlling portion 26 stops the closing operation of opening/closing body 2, and the locking controlling portion 27 locks the vehicle 1. Note that, when the open/closed state determination portion 24 determines that all opening/closing bodies of the vehicle 1 are in a closed state, the locking controlling portion 27 locks all the opening/closing bodies.

With regard to the locking of the vehicle 1, information indicating that each opening/closing body of the vehicle 1 is locked may be stored in the memory 22 (or the other ECU) of the control device 20, and the control device 20 may be configured such that the control device 20 cannot cause each opening/closing body to perform an opening/closing operation until the information is reset and the opening/closing body is unlocked. Further, an electric locking mechanism (not shown) that engages with the vehicle body of vehicle 1 may be provided in each opening/closing body, and the control device 20 may operate the locking mechanism such that the locking mechanism is engaged with the vehicle body of the vehicle 1 to lock the opening/closing body.

In S510, the control device 20 controls the light generator 61 to turn on a hazard, so that the user can be informed of completion of locking of the opening/closing body 2. Note that, at this time, a sound to inform the user of the completion may be generated from the sound generator 60.

In S511, since the second operation is not performed on the closing switch 10, the operation determination portion 25 determines that the normal operation is performed on the closing switch 10. Note that, at this time, the control device 20 may control the sound generator 60 so that the sound generator 60 generates a buzzer indicative of the normal operation to notify the user that a normal closing operation is performed.

In S512, the closing operation controlling portion 26 controls the drive unit 40 to cause the opening/closing body 2 to perform a closing operation. In S513, the control device 20 controls the sound generator 60 to generate a buzzer, so as to inform the user that the specific operation is unsuitable and the closing operation of the opening/closing body 2 and the locking of the vehicle 1 are not performed, and thus the flow is finished.

As described above, the control device 20 as the control device for the vehicle opening/closing body according to the present embodiment is configured such that, when the opening/closing body 2 is in an open state and the specific operation is performed by the user on the closing switch 10 that is provided to cause the opening/closing body 2 to perform a closing operation, the control device 20 causes the opening/closing body 2 to perform the closing operation, and locks the vehicle 1. Accordingly, it is not necessary to provide additional switches and the like to lock the vehicle 1 in addition to the closing switch that causes the opening/closing body 2 to perform the closing operation, thereby making it possible to reduce the number of components. Further, since an existing closing switch is used, it is possible to implement a function of the present embodiment by amending (changing) software of the control device, thereby making it possible to reduce cost for upgrading of the vehicle. Further, the user only needs to operate the closing switch 10 that causes the opening/closing body 2 to perform an opening/closing operation, in order to lock the vehicle 1. Thus, it is not necessary for the user to perform an additional action of, for example, taking out a portable, thereby making it possible to improve the convenience for the user. Further, at the time when the control device 20 receives the specific operation, the control device 20 generates a sound different from a sound generated when the normal operation is received (the control device 20 uses a buzzer and a melody for respective cases), so that the user can be informed that the opening/closing body 2 is closed and the vehicle 1 is locked. Thus, the user can leave the vehicle 1 before the opening/closing body 2 is closed and the vehicle 1 is locked, and thus, the convenience for the user is improved.

In the above embodiment, when a prescribed operation is performed by a user on the closing switch 10 that is provided in the opening/closing body 2 so as to cause the opening/closing body 2 to perform the closing operation, the control device 20 causes the opening/closing body 2 to perform the closing operation and locks the vehicle. Accordingly, it is not necessary for the user to take out a portable (a mobile device) at the time of locking the vehicle, and further, it is not necessary for the user to perform any additional operation on the portable to lock the vehicle. As a result, the convenience for the user is improved. Further, the vehicle can be locked only by performing, on the closing switch 10, the specific operation that causes the opening/closing body 2 to perform the closing operation. Accordingly, it is not necessary to provide another switch for locking, which can contribute to reduction of manufacturing cost.

Figure 6:
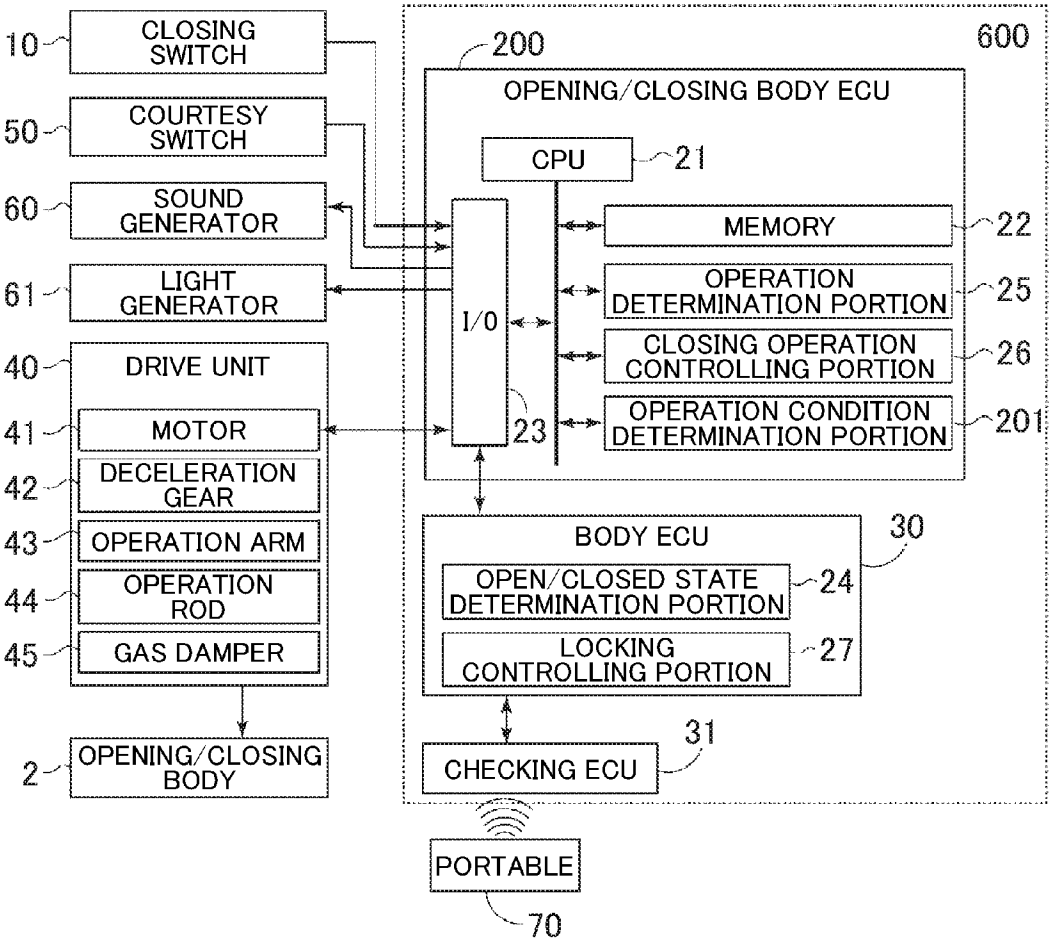
FIG. 6 is a block diagram of a control device and the like according to a second embodiment.

FIG. 6 is a block diagram of a control system 600 for a vehicle opening/closing body according to a second embodiment of the present invention. The control system 600 includes an opening/closing body ECU (Electronic Control Unit) 200, a body ECU 30, and a checking ECU 31, and these ECUs are connected to each other via buses. In the present embodiment, a back door of a vehicle 1 is regarded as an opening/closing body 2, but the present invention is not limited to this.

The opening/closing body ECU 200 is an ECU for the opening/closing body 2, and includes a CPU 21, a memory 22, an input-output circuit 23, an operation determination portion 25, a closing operation controlling portion 26, and an operation condition determination portion 201. The body ECU is a host ECU that controls an open/closed state of all opening/closing bodies of a vehicle 1 and locking of the vehicle 1, and includes an open/closed state determination portion 24 configured to determine an open/closed state of each opening/closing body, and a locking controlling portion 27 configured to control locking or unlocking of each opening/closing body. Note that constituents 21 to 27 are the same as those in the first embodiment, so descriptions thereof are omitted.

The opening/closing body ECU 200 includes an operation condition determination portion 201 as a functional portion realized (implemented) by the CPU 21 in accordance with a prescribed program stored in the memory 22. Based on information from the body ECU 30, for example, when the opening/closing body 2 is in an open state, and when a motor 41, a relay (not shown), or the like of a drive unit 40 has no abnormality, the operation condition determination portion 201 determines that a closing operation of the opening/closing body 2 is performable (i.e., the opening/closing body 2 is able to be closed).

The checking ECU 31 communicates with a portable (mobile device) 70 of a vehicle 1, and determines whether the portable 70 is inside the vehicle 1, or the portable 70 is placed outside the vehicle 1 so as to be within a range where the portable 70 can communicate with the checking ECU 31, or the portable 70 is placed at a position where the portable 70 cannot communicate with the checking ECU 31. Accordingly, when it is determined that the portable 70 is not placed inside the vehicle 1 and is placed outside the vehicle 1 so as to be within a range where the portable 70 can communicate with the checking ECU 31, the checking ECU 31 sends, to the body ECU 30, a "checking certification" signal indicating that the checking is successful, and the body ECU 30 sends it to the opening/closing body ECU 200. Further, when the checking ECU 31 receives a "locking request" command from the opening/closing body ECU 200, the checking ECU 31 performs checking on the portable 70 (that is, the checking ECU 31 determines that the portable 70 is not placed inside the vehicle 1 and is placed outside the vehicle 1 at a position where the portable 70 can communicate with the checking ECU 31), and sends a "locking permission" command to the body ECU 30.

Figure 7:
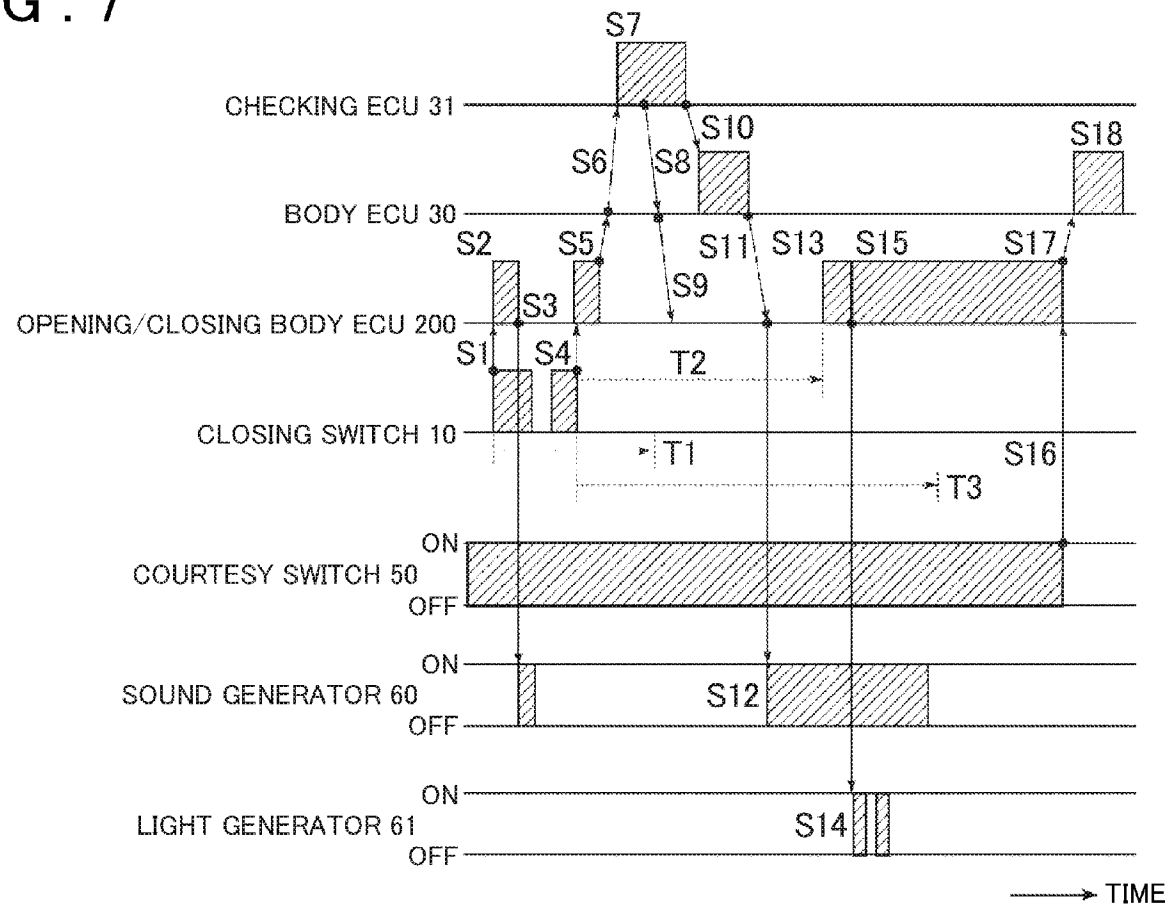
FIG. 7 is a timing chart regarding constituents according to the second embodiment.

FIG. 7 is a timing chart regarding constituents related to the control system 600.

In step S1, the user performs an operation on the closing switch 10 (i.e., the user operates the closing switch 10), so that the closing switch 10 sends a signal indicative of the operation to the opening/closing body ECU 200. In step S2, the operation determination portion 25 of the opening/closing body ECU 200 determines that a first operation is performed on the closing switch 10, based on the signal from the closing switch 10. At this time, the opening/closing body ECU 200 starts measurement of a prescribed time T1 from the first operation on the closing switch 10. Note that the prescribed time T1 is not limited, but is a time equal to or less than one second and may be 0.8 seconds, for example. In step S3, the opening/closing body ECU 200 controls a sound generator 60 to generate a buzzer, so as to inform the user that the operation is received.

In step S4, the user performs an operation on the closing switch 10 again (i.e., the closing switch 10 is operated again), so that the closing switch 10 sends a signal indicative of the operation to the opening/closing body ECU 200. In step S5, the operation determination portion 25 of the opening/closing body ECU 200 determines that a second operation is performed on the closing switch 10 after an OFF edge of the signal from the closing switch 10 is detected. Since the second operation is performed on the closing switch 10 within the prescribed time T1, the operation determination portion 25 determines that a specific operation is performed on the closing switch 10 by the user, and the opening/closing body ECU 200 sends a "locking request" command to the body ECU 30. Note that, in a case where the closing switch 10 is pressed and operated by the user within the prescribed time T1, but the OFF edge of the signal cannot be detected within the prescribed time T1, the opening/closing body ECU 200 may cancel the closing operation of the opening/closing body 2 and notify the user that the closing operation of the opening/closing body 2 is canceled, with the use of the sound generator 60.

After the opening/closing body ECU 200 detects the OFF edge of the signal from the closing switch 10 in step S5, the opening/closing body ECU 200 starts measurement of prescribed times T2 and T3. The prescribed time T2 is not limited, but is a time equal to or less than one second and may be 0.8 seconds, for example. The prescribed time T2 is a waiting time until the operation condition determination portion 201 of the opening/closing body ECU 200 starts determination on whether the closing operation of the opening/closing body 2 is performable (i.e., whether the closing operation of the opening/closing body 2 is able to be performed). That is, the operation condition determination portion 201 of the opening/closing body ECU 200 starts determination on whether the closing operation of the opening/closing body 2 is performable, after the prescribed time T2 elapses. Further, the prescribed time T3 is not limited, but is a time larger than T1 and T2. The prescribed time T3 is approximately five seconds, for example. The opening/closing body ECU 200 receives, from the after-mentioned body ECU 30, the "checking certification" signal and the after-mentioned "closing operation and locking output" command within the prescribed time T3, and when it is determined that the closing operation of the opening/closing body 2 is performable in an operation condition determination performed by the opening/closing body ECU 200 itself after the prescribed time T2 elapses, the opening/closing body ECU 200 causes the opening/closing body 2 to perform the closing operation.

In step S6, the body ECU 30 sends the "locking request" command to the checking ECU 31. In step S7, the checking ECU 31 that has received the "locking request" command communicates with the portable 70 and determines whether the portable 70 is not placed inside the vehicle 1 and is placed outside the vehicle 1 so as to be within a range where the portable 70 can communicate with the checking ECU 31. In step S8, the checking ECU 31 sends the "checking certification" signal to the body ECU 30, and in step S9, the body ECU 30 sends it to the opening/closing body ECU 200.

In step S10, the checking ECU 31 sends the "locking permission" command to the body ECU 30. In step S11, the open/closed state determination portion 24 of the body ECU 30 that has received the "locking permission" command checks that opening/closing bodies except the opening/closing body 2 of the vehicle 1 are in a closed state, and in order that the closing operation of the opening/closing body 2 and locking be performed, the open/closed state determination portion 24 sends the "closing operation and locking output" command to the opening/closing body ECU 200. In step S12, the opening/closing body ECU 200 controls the sound generator 60 to generate a melody sound indicating that the closing operation of the opening/closing body 2 is to be performed (i.e., the opening/closing body 2 is to be closed) and the vehicle 1 is to be locked subsequently, so that the user is informed of that.

Then, in step S13, when the prescribed time T2 has elapsed, the operation condition determination portion 201 of the opening/closing body ECU 200 determines whether the closing operation of the opening/closing body 2 is performable. That is, the operation condition determination portion 201 determines, based on information from the body ECU 30, whether the opening/closing body 2 is in an open state and whether the motor 41, a relay (not shown), or the like of the drive unit 40 has any abnormality. In step S14, when the operation condition determination portion 201 determines that the operation of the opening/closing body 2 is performable, the opening/closing body ECU 200 controls the light generator 61 to turn on a hazard, so as to inform the user that the closing operation of the opening/closing body 2 and locking are to be performed from then on.

Before the prescribed time T3 elapses, the opening/closing body ECU 200 receives the "checking certification" signal and the "closing operation and locking output" command, and the opening/closing body ECU 200 determines that the operation is performable in step S14. Therefore, in step S15, the closing operation controlling portion 26 of the opening/closing body ECU 200 starts the closing operation of the opening/closing body 2.

In step S16, since the opening/closing body 2 enters a closed state, the courtesy switch 50 sends an OFF signal to the opening/closing body ECU 200. In step S17, the opening/closing body ECU 200 that has received the OFF signal from the courtesy switch 50 stops the closing operation of the opening/closing body 2 and sends the OFF signal to the body ECU 30. In step S18, the open/closed state determination portion 24 of the body ECU 30 determines that the opening/closing body 2 and/or all opening/closing bodies are in a closed state, and the locking controlling portion 27 locks all the opening/closing bodies of the vehicle 1. Subsequently, by using a buzzer generated by the sound generator 60, hazard lighting of the light generator 61, and the like, the user may be informed of completion of locking of the vehicle 1 (answerback).

As described above, when the user performs the specific operation on the closing switch 10 at the time when the opening/closing body 2 is in an open state, the control system 600 for the vehicle opening/closing body according to the present embodiment causes the opening/closing body 2 to perform the closing operation and locks all the opening/closing bodies. Further, by performing the specific operation on the closing switch 10 of the opening/closing body 2, the user can reserve (make reservations for) the closing operation of the opening/closing body 2 and locking of all the opening/closing bodies, so that the user can leave the vehicle 1 before locking. Thus, the convenience for the user is improved.

(Other Embodiments) In another embodiment, when the closing switch 10 provided in the opening/closing body 2 is operated in a first direction, the opening/closing body 2 may be caused to perform the closing operation, and when the user operates the closing switch 10 in a second direction different from the first direction, the control device 20 or the opening/closing body ECU 200 may determine that the specific operation is performed on the closing switch 10. Further, the specific operation performed by the user is not limited to an operation performed on the closing switch 10 provided in the opening/closing body 2, and may be an operation that is performed on a switch that is provided in the portable 70 so as to cause the opening/closing body to perform an opening/closing operation. In this case, it is not necessary to provide another switch for locking, in the portable 70.

What is claimed is:

1. A control device for a vehicle opening/closing body, the control device comprising:

an electronic control unit configured to determine whether a user operating a closing switch that is provided in an opening/closing body of a vehicle to cause the opening/closing body to perform a closing operation performs a normal operation or a specific operation on the closing switch, the electronic control unit being configured to cause the opening/closing body to perform the closing operation when the electronic control until determines that the normal operation is performed, and to cause the opening/closing body to perform the closing operation, and to lock the vehicle when the electronic control unit determines that the specific operation is performed, wherein the electronic control unit is configured to generate a first sound when the electronic control unit determines that the normal operation is performed, and to generate a second sound different from the first sound when the electronic control unit determines that the specific operation is performed, the electronic control unit is configured such that, when the electronic control unit determines that a first operation is performed on the closing switch by the user, the electronic control unit determines that the normal operation is performed, the electronic control unit is configured such that, when the electronic control unit determines that a second operation is performed on the closing switch by the user within a prescribed time after the first operation is performed on the closing switch by the user, the electronic control unit determines that the specific operation is performed, and the electronic control unit is configured to, after detecting an OFF edge of a signal from the closing switch, determine that the second operation is performed on the closing switch.

2. The control device according to claim 1, wherein the electronic control unit is configured such that, when the second operation is not performed on the closing switch within the prescribed time after the first operation is performed on the closing switch, the electronic control unit determines that a normal operation is performed, and causes the opening/closing body to perform the closing operation, without locking the vehicle.

3. The control device according to claim 2, wherein the electronic control unit is configured to instruct an alarm to provide an indication to the user such that the indication provided to the user in a case where the specific operation is perform is different from the indication provided to the user in a case where the normal operation is performed.

4. A control system for a vehicle opening/closing body, the control system comprising:

a first electronic control unit configured to determine whether a user operating a closing switch that is provided in an opening/closing body of a vehicle so as to cause the opening/closing body to perform a closing operation performs a normal operation or a specific operation on the closing switch, the first electronic control unit being configured to cause the opening/closing body to perform the closing operation when the first electronic control unit determines that the normal operation or the specific operation is performed;

a second electronic control unit configured to determine whether a portable that communicates with the vehicle is not placed inside the vehicle and is placed outside the vehicle so as to be within a communicable range where the portable is able to communicate with the second electronic control unit; and a third electronic control unit configured to determine whether the opening/closing body is in a closed state, the third electronic control unit being configured to lock the vehicle when the first electronic control unit determines that the specific operation is performed, the second electronic control unit determines that the portable for the vehicle is not placed inside the vehicle and is placed outside the vehicle so as to be within the communicable range, and the third electronic control determines that the opening/closing body is in the closed state, wherein the first electronic control unit is configured to generate a first sound when the first electronic control unit determines that the normal operation is performed, and to generate a second sound different from the first sound when the first electronic control unit determines that the specific operation is performed, the first electronic control unit is configured such that, when the first electronic control unit determines that a first operation is performed on the closing switch by the user, the first electronic control unit determines that the normal operation is performed, the first electronic control unit is configured such that, when the first electronic control unit determines that a second operation is performed on the closing switch by the user within a prescribed time after the first operation is performed on the closing switch by the user, the first electronic control unit determines that the specific operation is performed, and the first electronic control unit is configured to, after detecting an OFF edge of a signal from the closing switch, determine that the second operation is performed on the closing switch.

* * * * *